US006237520B1

(12) United States Patent
Sisseren

(10) Patent No.: US 6,237,520 B1
(45) Date of Patent: May 29, 2001

(54) FOOTSTRAP FOR BOARD SPORTS

(76) Inventor: Michael van Sisseren, 3400B Guignard Dr., Hood River, OR (US) 97031

( * ) Notice: Subject to any disclaimer, the term of this patent is extended or adjusted under 35 U.S.C. 154(b) by 0 days.

(21) Appl. No.: 09/398,301

(22) Filed: Sep. 16, 1999

(51) Int. Cl.[7] ..... B63B 35/85
(52) U.S. Cl. ..... 114/39.19
(58) Field of Search ..... 114/39.19; 441/70, 441/75; 280/11.3, 14.2

(56) References Cited

U.S. PATENT DOCUMENTS 4,822,310 * 4/1989 Parker et al. ..... 441/70
4,846,744 * 7/1989 Love ..... 441/75
5,893,785 * 4/1999 Baldwin, III ..... 441/75

FOREIGN PATENT DOCUMENTS 0 346 509 * 12/1989 (EP) ..... 114/39.19

* cited by examiner

*Primary Examiner*—Sherman Basinger
(74) *Attorney, Agent, or Firm*—Flehr Hohbach Test Albritton & Herbert LLP

(57) ABSTRACT

A footstrap (26) having a first formed piece (50) and a second formed piece (52) that overlay each other and which are secured together by hook and loop fastener members (86, 78, 79, 74, and 48). A neoprene cover 44 enclosed the two pieces (50, 52). Pieces (50, 52) when overlapped, form an asymmetrical shape that better conforms to the shape of a sailboarder's foot.

15 Claims, 5 Drawing Sheets

FOOTSTRAP FOR BOARD SPORTS

FIELD OF THE INVENTION

The present invention pertains to footstraps for board sports such as windsurfing and the like and, more particularly, to the shape design of footstraps.

BACKGROUND OF THE INVENTION

The footstraps of windsurfing boards are typically plastic and/or nylon straps with a set of holes at either end for receiving screws to secure the footstrap to the sailboard. To make footstraps adjustable, sailboards commonly have more than one set of threaded screw holes, so that the configuration and position of the footstrap can be varied. Some footstraps themselves are adjustable, independent of the design of sailboards. For example, adjustable footstraps can be adjusted in height in order to enlarge or shrink the opening or gap of the footstrap. As a general rule, competitive sailors prefer a narrower and taller opening, which provides better fit and control, while a wider and shorter opening is better suited for recreational sailors, because it is easier to get a foot into such footstraps.

The present invention improves upon the design of current footstraps by improving their adjustability and functionality in order to improve the performance of footstraps.

SUMMARY OF THE INVENTION

Briefly described, the improved footstrap of the present invention comprises a shaped member having sufficient rigidity to maintain a pre-formed shape when used for board sports, wherein the shaped member is adapted to be mounted to a board in a manner creating a foot opening, and wherein the shaped member has an asymmetrical, arched profile that generally conforms to the shape of a person's foot.

According to an aspect of the invention, the asymmetrical profile is achieved by the shaped member having an arch that peaks at a point longitudinally off-center of the shaped member. Preferably, the shaped member is made from a structural plastic material.

According to another aspect of the invention, the shaped member includes a cover that encloses the shaped member. The cover conforms to the asymmetrical profile of the shaped member.

According to another aspect of the invention, the shaped member includes two shaped pieces that overlap and are held by the cover to form an asymmetrical profile.

According to another embodiment of the invention, the footstrap of the present invention includes a first formed piece for securing at one end to the board, a second formed piece for securing at an opposite end to the board with the second formed piece at least partially overlapping the first formed piece when the two pieces are secured to the board, and a strap fixedly attached to one of the first and second formed pieces and adjustably attached to the other of the first and second formed pieces, so that the length of the strap between the points of attachment to the first and second formed pieces can be adjusted in order to adjust the size of the footstrap to accommodate different size feet, and wherein the first and second formed pieces are shaped to form an asymmetrical profile for the footstrap when mounted to the board.

According to an aspect of this embodiment, the first formed piece has a curvature greater than the curvature of the second formed piece so that upon over lap of the first and second formed pieces, an asymmetrical curved footstrap is formed.

According to another aspect of the invention, the first and second formed pieces have flanged ends for securing to the board, and wherein the curvature of the formed pieces begins at the inner ends of the flanged ends. Preferably, the angle between the flanged end of the first formed piece and the initial curved portion of the first formed piece closest to the flanged end is greater than the angle between the flanged end of the second formed piece and the initial curved portion of the second formed piece closest to the flanged end of the second formed piece.

According to another aspect of this embodiment of the invention, the first and second formed pieces are made of a material that provides structural rigidity to the formed pieces so that the footstrap does not collapse when stepped on. Preferably, the structural rigidity of the formed pieces is sufficient to maintain the curved shape of the footstrap when the footstrap is not mounted to the board. An example of such a material is a structural plastic.

According to another aspect of the invention, the footstrap further comprises a strap fixedly attached to one of the first and second formed pieces and adjustably attached to the other of the first and second formed pieces, so that the length of the strap between the points of attachment to the first and second formed pieces can be adjusted in order to adjust the size of the footstrap to accommodate different size feet.

According to another aspect of the invention, the footstrap further comprises a sleeve for at least partially enclosing the first and second formed pieces to maintain the overlap between the two pieces.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

In the drawings, like reference numerals refer to like parts throughout the several views, wherein.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
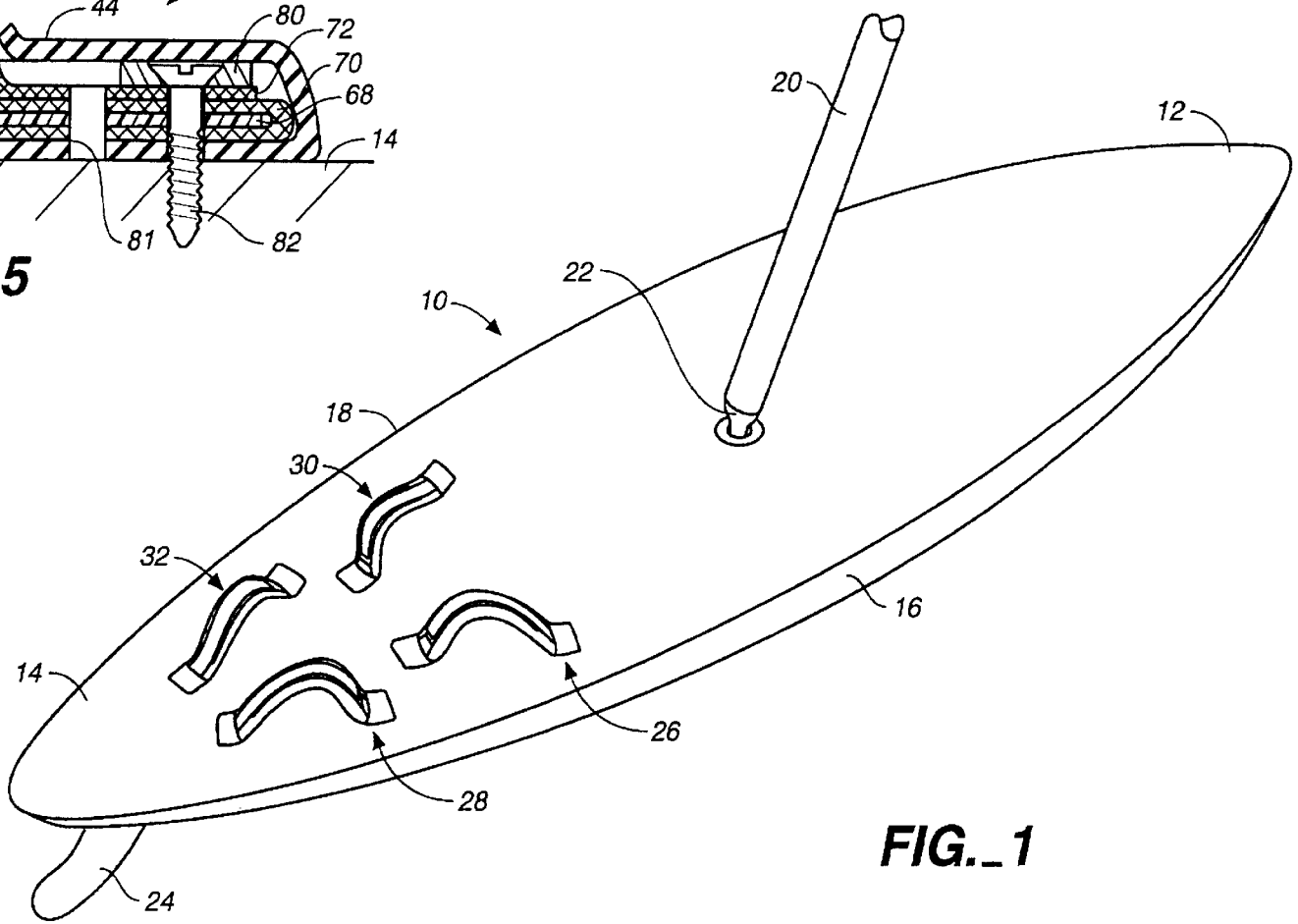
FIG. 1 is a pictorial view of a sailboard with four footstraps of the present invention mounted thereon.

In FIG. 1, a conventional sailboard 10 in shown, which includes a front end 12 and a tail end 14 with left and right side rails 16, 18. A portion of a mast 20 is shown attached at a mast base 22 at the center of the sailboard 10. A fin 24 is secured at the tail end 14 of the sailboard.

Also secured at the tail end of the sailboard are four footstraps 26, 28, 30, 32, each designed in accordance with the present invention. Footstraps 26 and 30 are front footstraps and are reverse mounted on sailboard 10 as compared to footstraps 28 and 32, which are back footstraps. Front and back footstraps 26 and 28 are used as a pair when the wind is approaching side rail 16, with a persons right foot positioned in footstrap 26 and the person's left foot positioned in footstrap 28. Footstraps 30 and 32 are used when the wind approaches side rail 18, with the right foot in footstrap 32 and the left foot in footstrap 30.

Figure 2A:
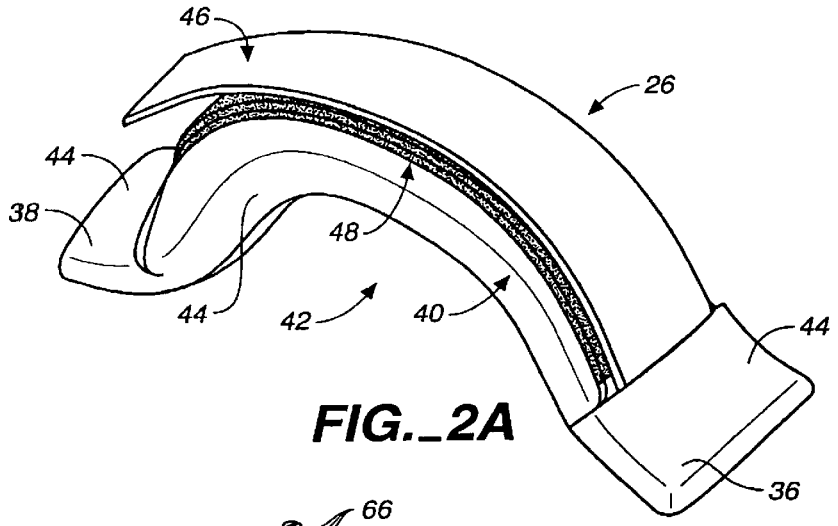
FIG. 2A is a pictorial view of the footstrap of the present invention.
Figure 2B:
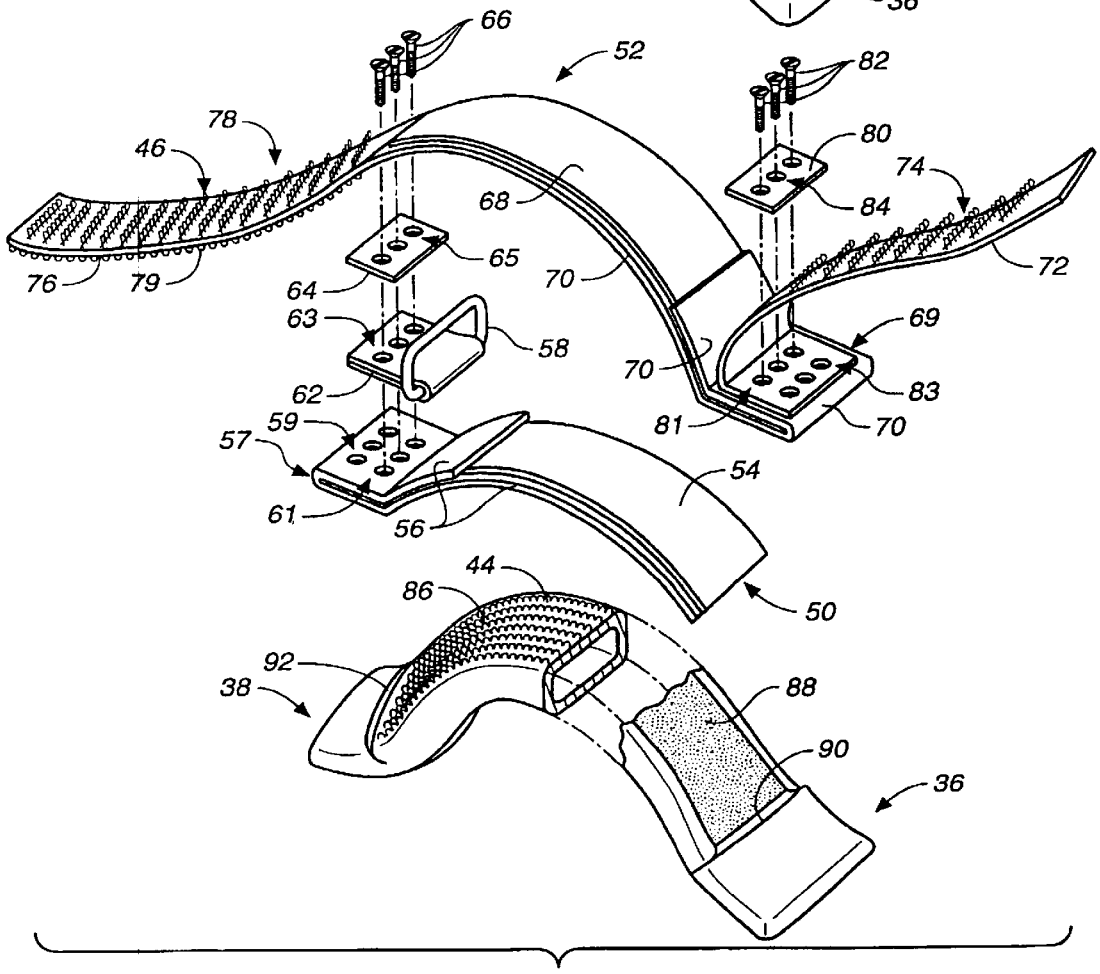
FIG. 2B is an exploded view of the footstrap of FIG. 2A.

Referring to FIGS. 2A and 2B, footstrap 26 is shown in pictorial view. The other three footstraps are identical. Footstrap 26 has a pair of flanged ends 36, 38 for mounting flush on the upper surface of the sailboard and a middle, arched section 40 that creates a gap 42 beneath the footstrap for inserting a foot "into" the footstrap. Footstrap 26 includes a neoprene cover sleeve 44 and an outer adjustable flap 46 that utilizes a hook and loop fastener arrangement 48 to secure the flap against itself in order to securely adjust the size and shape of the footstrap.

As shown in FIG. 2B, within neoprene cover sleeve 44 of footstrap 26 are included a first formed piece 50 and a second overlapping formed piece 52. First formed piece 50 includes a shaped piece of polyurathane plastic 54 (or a blend thereof) and a sewn nylon cover 56, which wraps around the flanged mounting end 57 of piece 50. Stitching is used to secure cover 56 to the shaped piece of plastic 54. Formed pieces 50, 52 are made of a material having sufficient structural rigidity to prevent the footstrap from permanently collapsing or otherwise deforming when stepped on. Yet, the footstrap material should have a minimum amount of flexibility in order to conform to a sailboarder's foot.

Mounting end 57 includes two rows of openings 59, 61, with row 61 being spaced inwardly from row 59. Openings 59, 61 allow for in and out adjustment of a loop ring 58 and a top plate 64, which changes the size of the opening or gap 42 for a sailboarder's foot.

Figure 6:
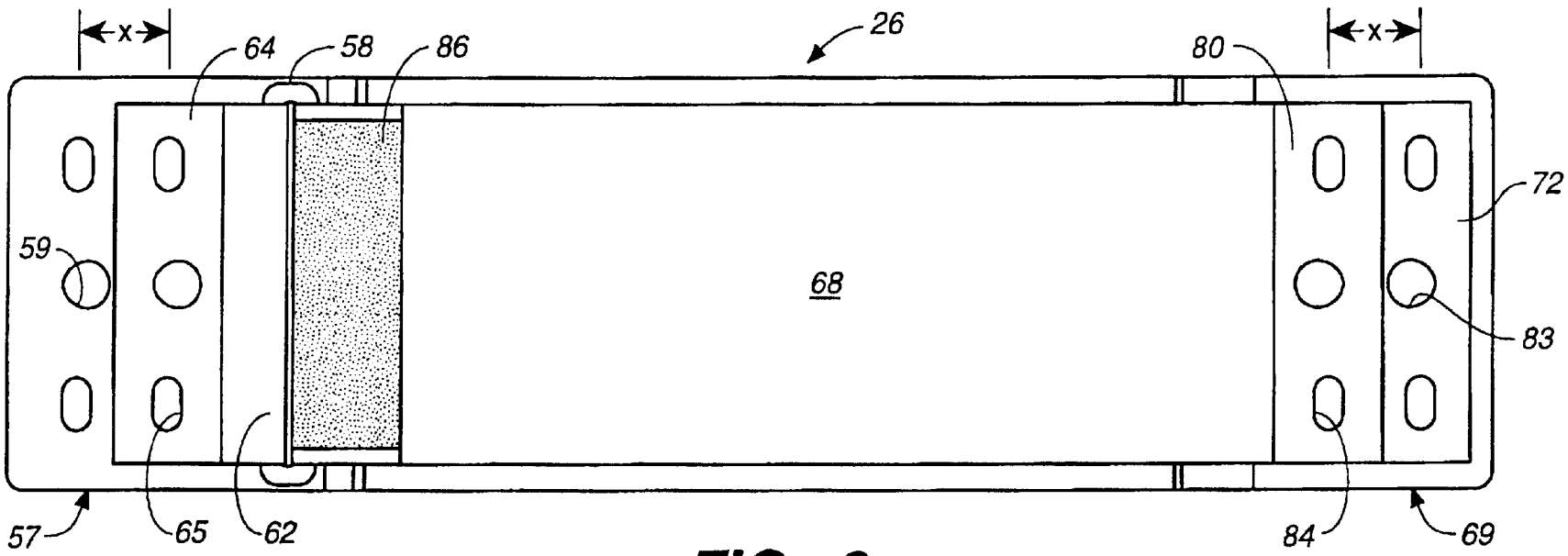
FIG. 6 is a plan view of the footstrap showing hole openings at each end of the footstrap.

As shown in FIG. 6, loop ring 58 is secured at mounting end 57 by means of a folded nylon flap 62 having openings 63, which is secured to mounting end 57 by means of top plate 64. Top plate 64 includes openings 65 and overlays folded flap 62 and bolts 66 extend through openings 65, 63, 59 or 61 and through sleeve 44 and into threaded openings of the sailboard.

Referring to FIGS. 2B and FIG. 6, the second formed piece 52 includes a formed piece of polyurathane plastic 68 with a nylon cover 70 stitched thereto. The formed plastic piece 68 and cover 70 are shaped to form a flanged end 69, similar to flanged end 57 of first formed piece 50. In addition, a first strap piece 72 is sewn to cover 70 at 10 flanged end 69 and includes hooks 74 on its inside surface. Preferably, first strap piece 72 is as long as second formed piece 52.

A second strap piece 76 is sewn to the opposite end of cover 70 and includes hooks 78 on its under side (shown 15 in a flipped position) and loops 79 on its top side. To fasten the footstrap, second strap 76 is looped through loop ring 58 and folded back onto the top side of sleeve 44, as discussed later. First strap 72 and second strap 76 together form adjustable strap 46. Flanged end 69 also 20 includes two rows of openings 81, 83.

Figure 5:
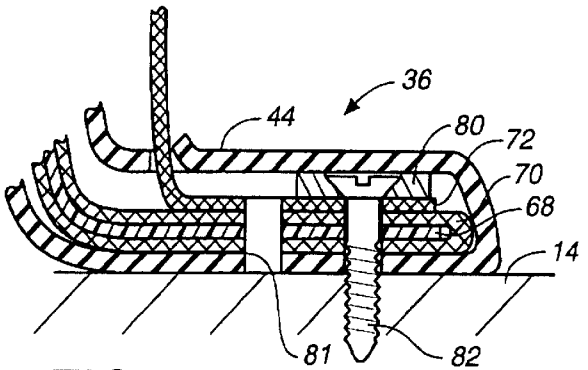
FIG. 5 is an enlarged sectional view of one end of the footstrap of the invention.

A small rectangular plate 80 is also provided with openings 84 for receiving mounting bolts 82, which extend through the openings 81 or 83 in flanged end 69 and corresponding parts of sleeve 44 and into threaded holes in the 25 sailboard, as shown in FIG. 5. Openings 81, 83 provide similar adjustment for the size of the opening of the footstrap as do openings 59, 61.

In FIG. 2B, formed pieces 50 and 52 are shown as two-piece units, each with a formed piece of plastic and a nylon cover. Alternatively, these units could be manufactured as single-piece molded plastic pieces of the same general shape and with similar hole patterns. Furthermore, units 50 and 52 could be manufactured as a single, preformed piece with the asymmetrical shape. A single-piece footstrap obviously would not have the size adjustment feature of a two-piece footstrap, but would still have the advantages of an asymmetrical design as discussed herein.

Neoprene sleeve 44 includes a looped top 86 that fastens with the hooks 78 of strap 76, and an internal comfort pad 88. In addition, pockets 90, 92 are formed at the ends of neoprene sleeve 44. Pockets 90, 92 define lateral slots that allow for the insertion of the flanged ends 57, 69 and pieces 50, 52 in a manner that captures the flanged ends and prevents their release from sleeve 44.

Figure 3:
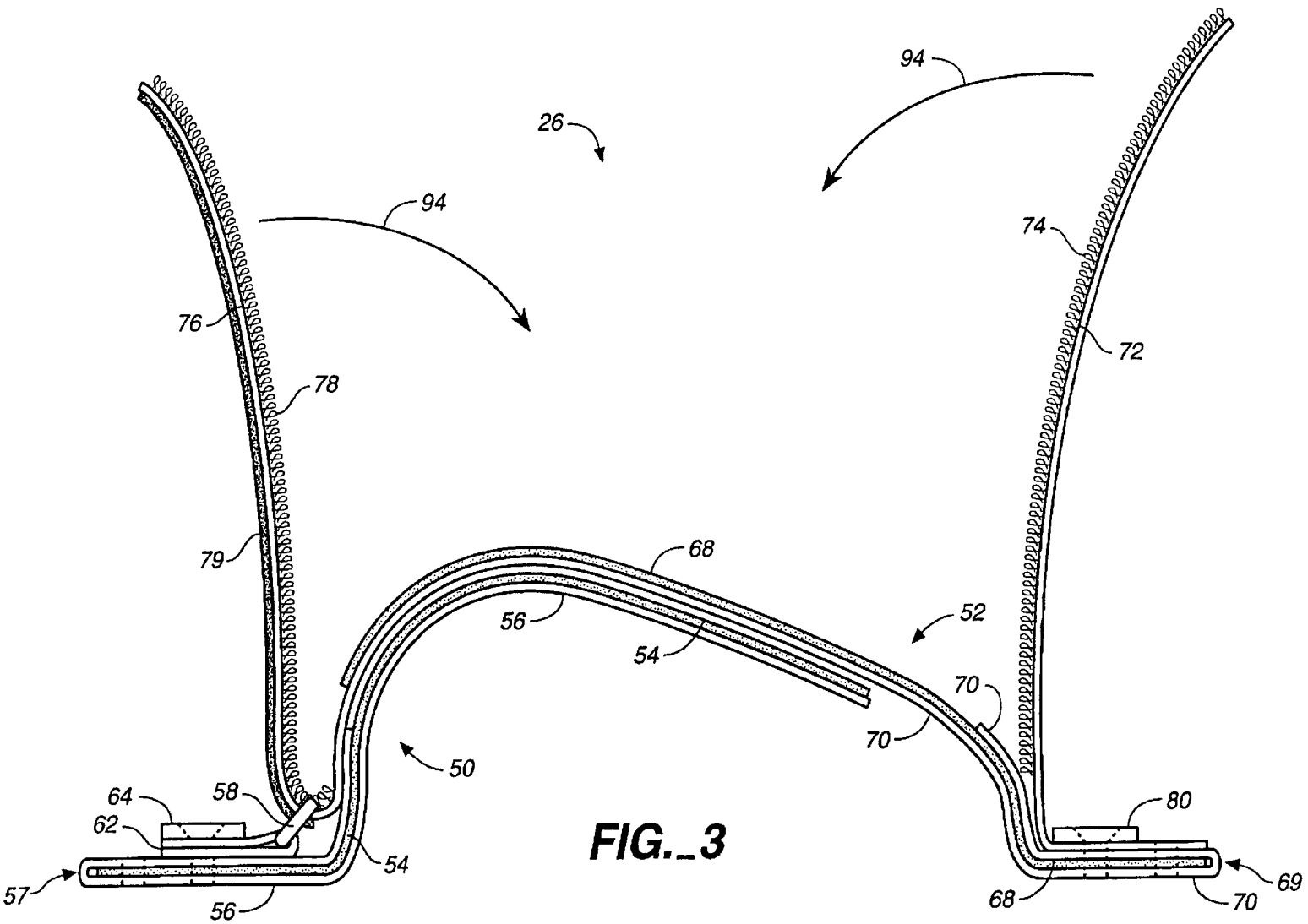
FIG. 3 is a longitudinal sectional view of the footstrap of the invention.

Referring to FIG. 3, footstrap 26 is shown in an unstraped position with first strap 72 upright and unhooked from the loops of second strap 72, also shown upright. In FIG. 3, it can be seen that second strap 76 loops through ring 58 in order to fold back against the neoprene sleeve (not shown).

The curvature of piece 50 is greater than the curvature of piece 52, at least initially where the curvature of the pieces start adjacent their respective flanged ends 57, 69. Stated another way, the angle between the flanged end 57 of the first formed piece 50 and the initial curved portion of the first formed piece closest to the flanged end is greater than the angle between the flanged end 69 of the second formed piece 52 and the initial curved portion of the second formed piece closest to the flanged end of the second formed piece.

Formed piece 52 overlays formed piece 50 with sufficient overlap that a range of adjustability is provided to expand and contract the size of the opening or gap formed by the footstrap, in order to accommodate different size feet and to modify the configuration of the footstrap for different types of sailors. Adjustment of footstrap 26 can take place in one of two ways. First, the footstrap can be mounted to a variety of sailboards with different mounting hole locations and spacing. With closer mounting holes, more overlap will be desirable between first formed piece 50 and second formed piece 52. with longer mounting hole locations, the formed pieces can move away from each other and still maintain sufficient overlap for support and fit of a windsurfer's foot.

Figure 4A:
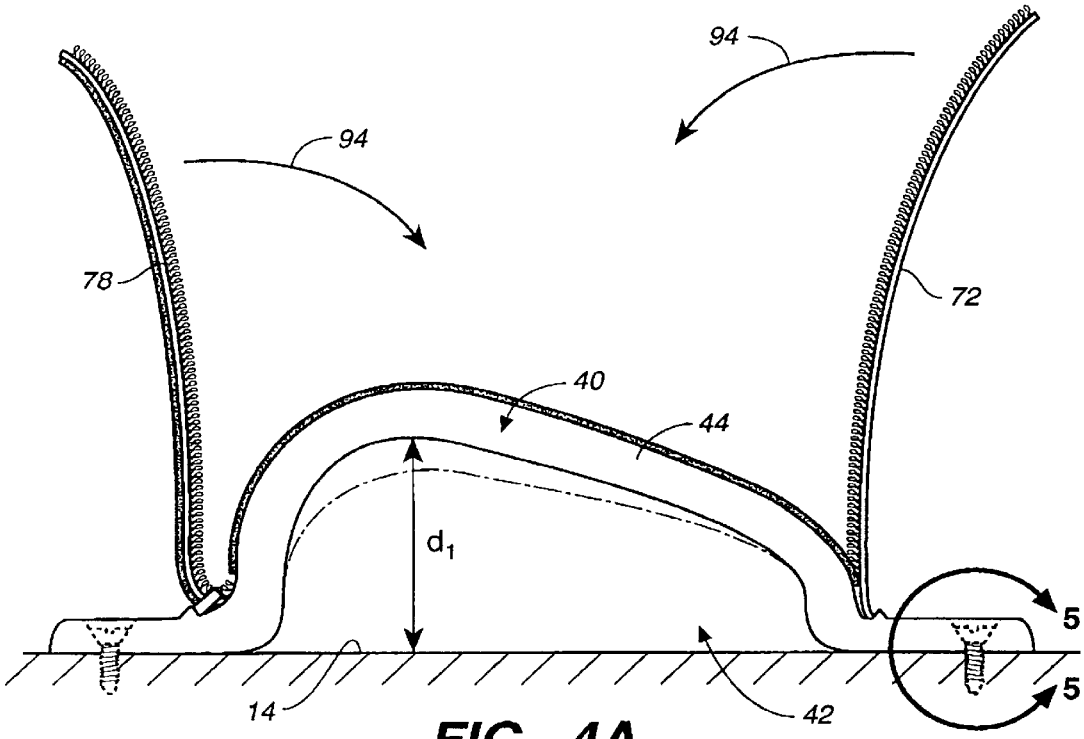
FIGS. 4A–4B are side elevation views of the footstrap of the invention, with the footstrap flaps shown in FIG. 4A in their open position.
Figure 4B:
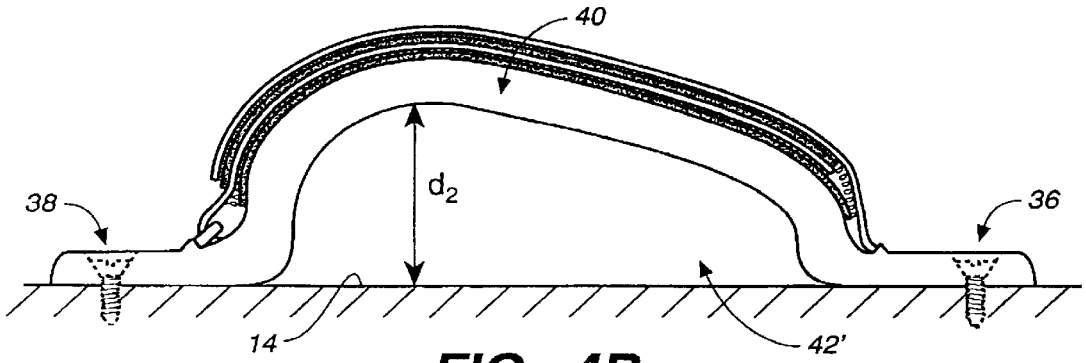

A second way to adjust footstrap 26 is shown in FIGS. 4A–4B. For a larger windsurfer's foot, the formed pieces are raised, which spreads the pieces (and reduces overlap) and then straps 78, 72 are closed, as shown by arrows 94. This creates a gap 42 with a greater height $d_1$ (FIG. 4A) and thus creates a greater opening for a larger foot. For a smaller foot, the formed pieces are pushed down, which increases their overlap and reduces the height $d_2$ of gap 42'.

FIG. 6 shows the lateral adjustability of footstrap 26 provided by outside holes 59, 83 and by inside holes 61, 81 (holes 61, 81 are covered up by plates 64, 80 but holes 65, 84 in these plates align with inside holes 61, 81). The lateral adjustment is shown by reference letter X. Footstrap 26 can be mounted to a board thru use of outside holes 57, 69, which narrows the foot opening of the footstrap by bringing the formed pieces closer together. Similarly, footstrap 26 can be mounted thru inside holes 61, 81, which widens the foot opening by separating the formed pieces. These adjustments lateral position the sides of the footstrap for a closer fit to a person's foot.

An important feature of the invention is the asymmetrical profile of the footstrap, as shown in FIGS. 4A–4B. The highest portion of middle, arched section 40 of footstrap 26 is closer to flange 38 than flange 36. However, arched section 40 could peak at a point longitudinally off-center in either direction of the footstrap. The off-set peak creates an symmetrical gap 42 that more closely conforms to the shape of a person's foot. As a result, comfort is increased and, perhaps more importantly, the fit of the footstrap is improved, which enhances control of the sailboard. While the present invention has been described in connection with a sailboard for windsurfing, the footstrap of the present invention can be used for other types of boards, such as surfboards, wakeboards, waterskis and other types of board sports requiring a footstrap or binding, and the use of the term "board" in the claims is not meant to limit the present invention to a particular type of board sport.

In addition, the materials described herein are believed to be preferred materials for the particular components described, but other materials generally known to those skilled in the art can be substituted without departing from the scope of the invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto when read and interpreted according to accepted legal principles such as the doctrine of equivalents and reversal of parts.

What is claimed is:

1. A footstrap for a board, comprising:

a shaped member having sufficient rigidity to maintain a pre-formed shape when used for board sports, the shaped member adapted to be mounted to the board in a manner creating a foot opening, the shaped member having an asymmetrical, arched profile that generally conforms to the shape of a person's foot.

2. The footstrap of claim 1 wherein, the asymmetrical profile is achieved by the shaped member having an arch that peaks at a point longitudinally off-center of the shaped member.

3. The footstrap of claim 2 wherein, the shaped member is made from a structural plastic material.

4. The footstrap of claim 1 wherein, the shaped member further includes a cover enclosing the shaped member.

5. The footstrap of claim 4 wherein, the shaped member includes two shaped pieces that overlap and are held by the cover to form an asymmetrical profile.

6. The footstrap of claim 5 wherein, the cover conforms to the asymmetrical profile of the footstrap.

7. A footstrap for a board, comprising:

a first formed piece for securing at one end to the board, a second formed piece for securing at an opposite end to the board with the second formed piece at least partially overlapping the first formed piece when the two pieces-are secured to the board, and a strap fixedly attached to one of the first and second formed pieces and adjustably attached to the other of the first and second formed pieces, so that the length of the strap between the points of attachment to the first and second formed pieces can be adjusted in order to adjust the size of the footstrap to accommodate different size feet, and wherein, the first and second formed pieces are shaped to form an asymmetrical profile for the footstrap when mounted to the board.

8. The footstrap of claim 7 wherein, the first formed piece has a curvature greater than the curvature of the second formed piece so that upon over lap of the first and second formed pieces, an asymmetrical curved footstrap is formed.

9. The footstrap of claim 7 wherein, the first and second formed pieces have flanged ends for securing to the board, and wherein the curvature of the formed pieces begins at the inner ends of the flanged ends.

10. The footstrap of claim 9 wherein, the angle between the flanged end of the first formed piece and the initial curved portion of the first formed piece closest to the flanged end is greater than the angle between the flanged end of the second formed piece and the initial curved portion of the second formed piece closest to the flanged end of the second formed piece.

11. The footstrap of claim 7 wherein, the second formed piece overlays the first formed piece.

12. The footstrap of claim 7 wherein, the first and second formed pieces are made of a material that provides structural rigidity to the formed pieces so that the footstrap does not collapse when stepped on.

13. The footstrap of claim 12 wherein, the structural rigidity of the formed pieces is sufficient to maintain the curved shape of the footstrap when the footstrap is not mounted to the board.

14. The footstrap of claim 13 wherein, the formed pieces are made of a plastic material.

15. The footstrap of claim 7 and further comprising a sleeve for at least partially enclosing the first and second formed pieces to maintain the overlap between the two pieces.

* * * * *